US005803233A

United States Patent [19]

Ferrara et al.

[11] Patent Number: 5,803,233

[45] Date of Patent: Sep. 8, 1998

[54] VIBRATORY FINISHING EQUIPMENT

[75] Inventors: Nicholas K. Ferrara, Scottsdale, Ariz.; Giuseppe Astorino, Roselle, Ill.

[73] Assignee: Ultramatic Equipment Co., Addison, Ill.

[21] Appl. No.: 704,882

[22] Filed: Aug. 30, 1996

[51] Int. Cl.[6] ..... B65G 27/02

[52] U.S. Cl. ..... 198/756

[58] Field of Search ..... 198/752.1, 756, 198/758, 763

[56] References Cited

U.S. PATENT DOCUMENTS

| | | | |
|---|---|---|---|
| 13,622 | 10/1855 | Pearn | 198/752.1 |
| 2,877,890 | 3/1959 | Carrier, Jr. | 198/756 |
| 3,882,820 | 5/1975 | Hock et al. | 198/756 X |
| 3,991,524 | 11/1976 | Ferrara | 241/175 |

FOREIGN PATENT DOCUMENTS

| | | | |
|---|---|---|---|
| 3832593 | 2/1990 | Germany | 198/756 |
| 383657 | 9/1973 | U.S.S.R. | 198/756 |

*Primary Examiner*—James R. Bidwell
*Attorney, Agent, or Firm*—Douglas B. White

[57] ABSTRACT

The vibratory finishing equipment of the present invention employs a plurality of cylindrical tube members, spatially positioned relative to one another and interconnected by a tubular member having a series of three 60° turns, such that flow proceeds effectively from one tube to the next. Media and piece parts are provided into the inlet of the uppermost tube and withdrawn from the outlet of the lowermost tube. Vibration is provided by an off-center weighted rotor located in proximity to the tubes.

12 Claims, 3 Drawing Sheets

VIBRATORY FINISHING EQUIPMENT

BACKGROUND OF THE INVENTION

1. Field of the Invention

This invention relates generally to vibratory finishing equipment of the tube type, and more particularly to a multiple interconnected tube improvement.

2. Description of the Prior Art

Vibratory finishing equipment is well established in the art and typified by U.S. Pat. No. 3,991,524, the description of which is incorporated herein by reference. In this type of machine a tube or cylinder is resiliently mounted to a base. A vibration inducing device in the form of an off-center weighted rotor is mounted to the tube or supporting structure to induce vibratory motion. This vibration in turn induces a vibrating flow of the contents (media and piece parts) through the tube. Accordingly, control of the motion of the contents has been a main objective in the art and is affected both by the placement of the vibratory inducing device and by the geometry of the container. Cylindrical tube forms of vibrating equipment have been found to provide the greatest cutting power over other geometrical forms and are preferred for many applications. However, for long cycle times, the extensive linear floor space requirements are often prohibitive.

SUMMARY OF THE INVENTION

The main objective of the present invention is to achieve the cutting characteristics of the cylinder-type of machines for long cycle times but without the extensive floor space required of prior art cylinder-type machines. It is also an objective to achieve a design which can be easily modified to selectively vary the tube length and therefore the cycle time. It is finally an object to achieve such a design while maintaining an effective flow of media and piece parts throughout the machine.

The vibratory finishing equipment of the present invention employs a plurality of cylindrical tube members, horizontally mounted and spatially positioned relative to one another. Moreover, they are interconnected such that media and piece parts flow smoothly from one tube to the next succeeding tube. This interconnection is accomplished by positioning the discharge outlet of any one tube at a higher elevation than the inlet to the next tube and accomplishing the 1800 turn by a series of three abrupt 60° direction changes. Media and piece parts, provided into the inlet of the first tube and withdrawn from the outlet of the last tube in the series, will, with this geometry, flow smoothly through the series of interconnected tubes. Vibration is provided by the off-center weighted rotor technique and is located in close proximity to the tubes. In one preferred embodiment, with the tubes in a radially spaced array about a center point, the vibration inducing member is located in the center, equidistant from each of the tubes, and affixed to the tube mounting structure.

Figure 1:
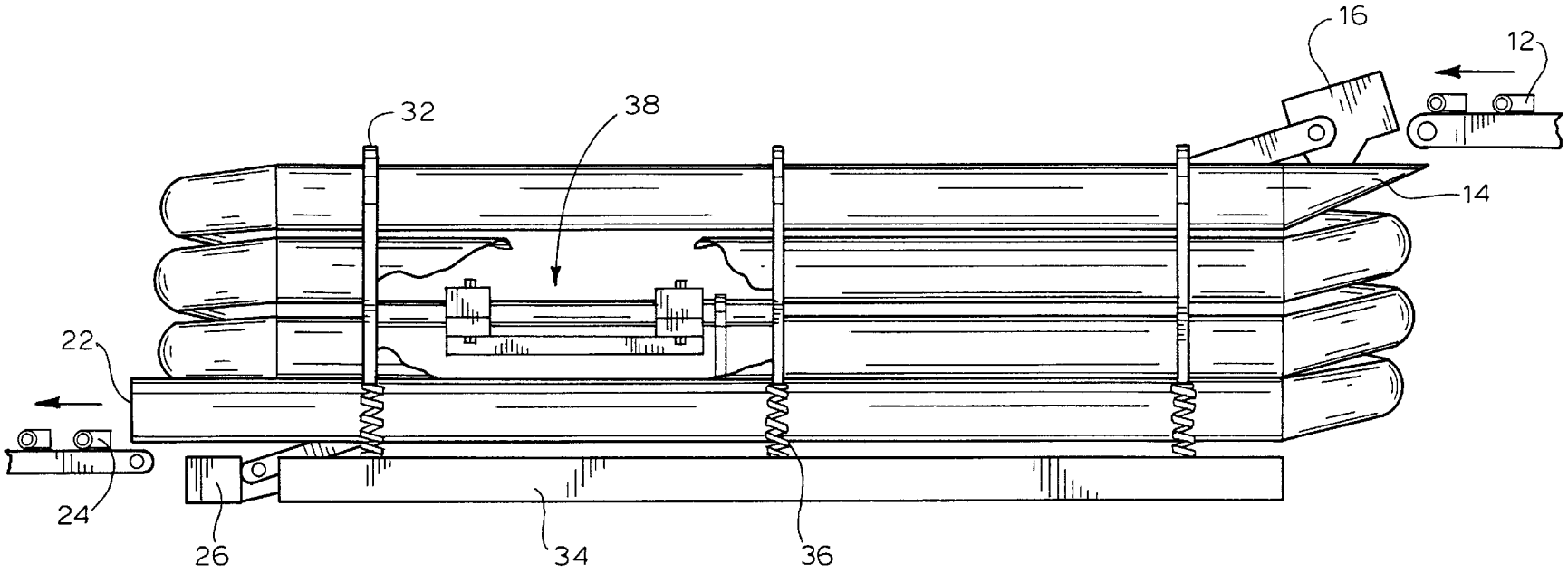
FIG. 1 is a side view, partially cut away, of the vibratory finishing equipment in accordance with the present invention and selectively interconnected to provide the longest tube length and cycle time.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Turning to the drawings, there are shown two embodiments of a multiple tube vibratory finishing machine. While such a machine may be composed simply with two or more interconnected tubes, a plurality of tubes positioned equidistant from a center, as shown, is preferred. Consistent with prior art equipment (see U.S. Pat. No. 3,991,524, incorporated herein by reference), unfinished parts 12 (see FIG. 1) are conveyed to the inlet 14 where a hopper 16 also delivers polishing media. At the machine outlet 22 finished piece parts 24 are retrieved and media is collected by a conveyor 26 to be returned to the inlet 14.

The interconnectable tube configuration of the present invention is mounted within a base structure formed by vertical steel plates 32 resiliently supported over a solid base 34 by means of springs 36. Vibration is provided by one or more rotating off-center weight mechanisms 38 mounted to the base frame structure 32 and driven by a motor, in a manner well known in the art. Optimally, the vibrating mechanism is located substantially along the center axis of the tube configuration (or approximately equidistant from the tube axes), but other locations on the frame structure (such as on the periphery) within proximity to the tubes are also within the scope of the invention.

Figure 2:
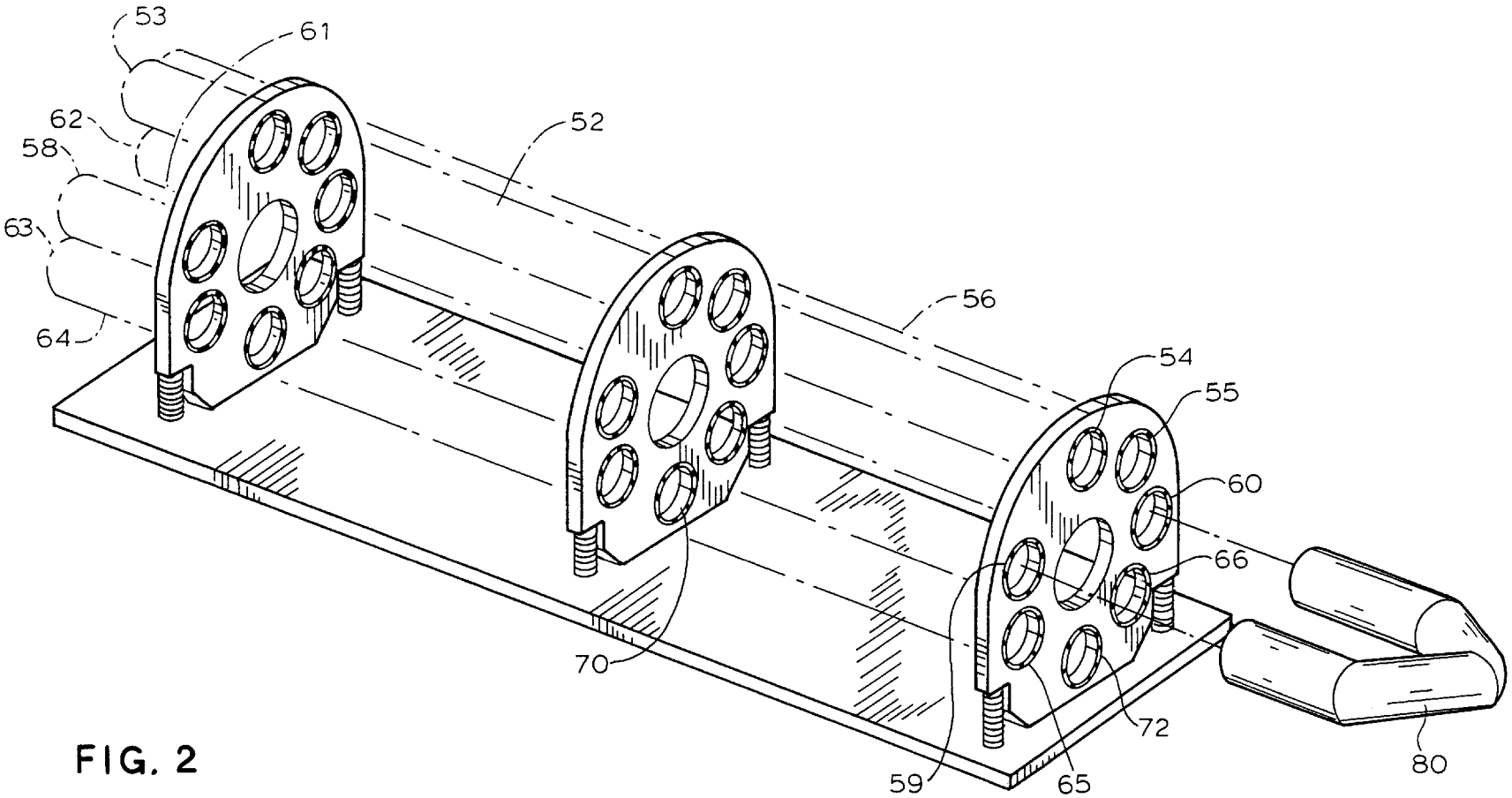
FIG. 2 is a perspective view of a portion of the equipment of FIG. 1, with the tubes shown in phantom and with one tube end interconnection shown removed.

Portions of the tube configuration of the preferred embodiment are depicted pictorially in FIG. 2, with the tubes shown in phantom. When interconnected to provide the longest combined tube length an uppermost tube 52 is positioned to receive media and piece parts at its inlet 53 and to direct the flow from its outlet 54 through an interconnection to the inlet 55 of the next tube 56. In turn, tube 56 is connected to provide flow to the next lower tube 58. The outlet 59 of tube 58 provides flow to the inlet 60 of the next lower tube 61. In turn, the outlet 62 of tube 61 directs flow into the inlet 63 of the next lower tube 64. The outlet of the tube 64 is similarly connected at its outlet 65 to the inlet 66 of the next lower tube. And finally through a similar connection, flow is directed to the lowermost tube 70 from which it exits at its outlet 72. Of course for shorter combined tube lengths, any outlet may be connected to any inlet of lower elevation to achieve the desired combined tube length. Similarly, more than one path can be established by defining more than one inlet and outlet for piece parts and media, thereby performing multiple operations at once.

Providing the interconnections between tubes are connecting means 80, one of which is shown in perspective in FIG. 2 positioned to interconnect outlet 59 to inlet 60. The preferred embodiment of the connecting means is a tubular member of the same diameter as the cylindrical tubes and presenting a series of three abrupt direction changes, with each being approximately 60° of the 180° turn. This achieves the 180° direction reversal of the vibrating flow within the tubes while maintaining a smooth transition that does not impede flow.

Figure 3:
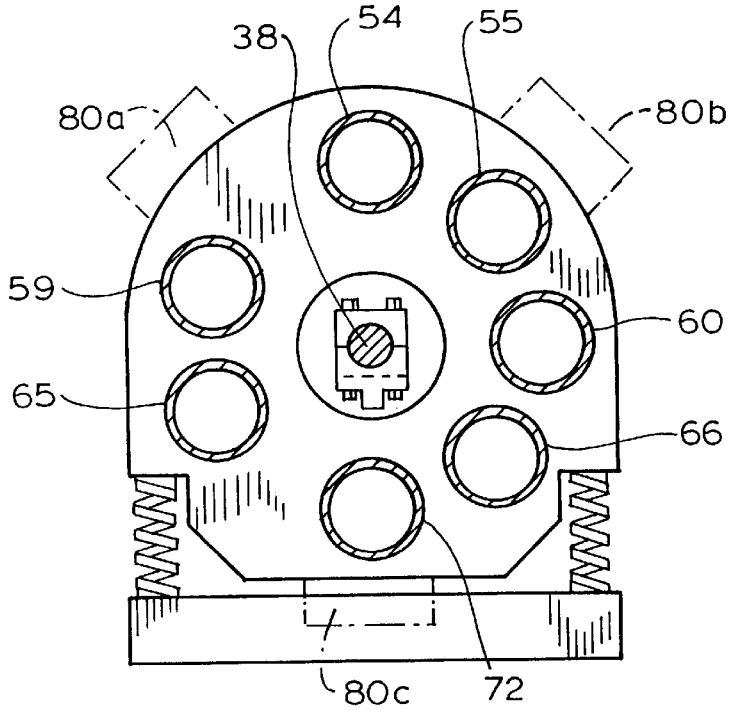
FIG. 3 is a cross sectional view, at a base mounting structure, of the equipment of FIG. 1.

Turning now to FIG. 3, a cross-sectional view of the equipment is shown. Particularly, FIG. 3 depicts the machine of FIG. 1 showing the relative spacial positioning of the array of tubes placed approximately equidistant from the center. The vibration mechanism 38 is shown mounted in the preferred center position, but may alternatively be positioned proximate the tubes around their periphery. Alternate positions 80*a*, 80*b*, and 80*c* are examples of such peripheral locations.

Figure 4:
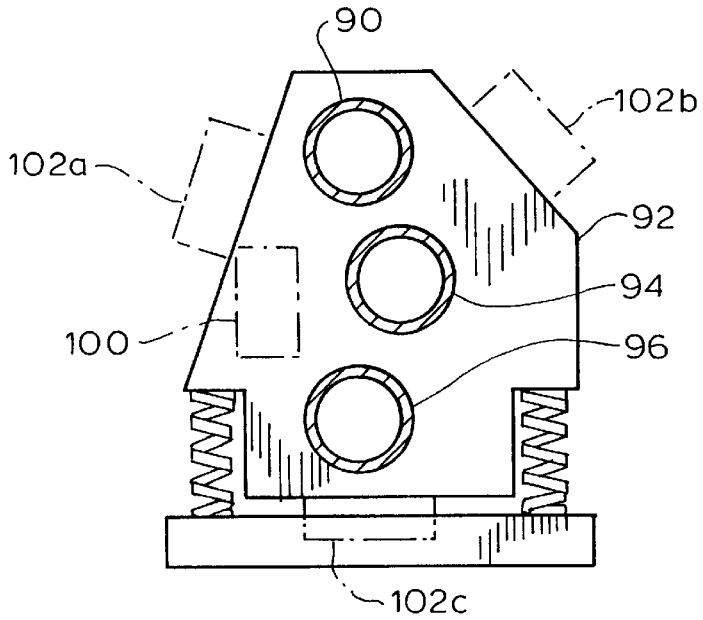
FIG. 4 is a cross sectional view, at a base mounting structure, of an alternative tube arrangement consistent with the present invention and interconnectable to provide one, two or three different tube lengths.

In FIG. 4 an alternative positioning of the tubes is shown, with the tubes stacked above one another. The uppermost tube 90 is mounted to the steel plate mounting structure 92 and arranged to receive the inflow of parts and media. An intermediate tube 94 is mounted to the structure below the uppermost tube and interconnected to receive flow from the outlet of uppermost tube. (Additional intermediate tubes may also be incorporated into this embodiment in the same manner.) Finally, a lowermost tube 96 is positioned to receive flow from the intermediate tube and to discharge finished piece parts. As with the previously described embodiment, the vibration producing mechanism 100 is optimally positioned proximate and equidistant from the tubes. Alternatively, though not preferred, peripheral locations, such as 102*a*, 102*b*, or 102*c*, can be used.

From the foregoing description, it will be apparent that modifications can be made to the apparatus and method for using same without departing from the teachings of the present invention. Accordingly, the scope of the invention is only to be limited as necessitated by the accompanying claims.

We claim:

1. Vibratory finishing equipment for vibrating piece parts in a finishing media comprising:

a base structure;

a pair of cylindrical tubes mounted to said base structure and defining an upper tube and a lower tube, each tube having an inlet and an outlet;

connecting means for selectively interconnecting said outlet of said upper tube to said inlet of said lower tube, wherein said connecting means comprises a tubular member exhibiting a series of three defined direction changes of approximately 60° each; and vibrating means for causing vibratory motion within said cylindrical tubes.

2. The vibratory finishing equipment of claim 1 wherein said vibrating means is mounted to said base structure substantially equidistant from each of said tubes.

3. The vibratory finishing equipment of claim 1 wherein said vibrating means comprises an off-center weighted rotor.

4. The vibratory finishing equipment of claim 1 wherein said vibrating means is mounted to said base structure proximate the periphery of said vibrating finishing equipment.

5. Vibratory finishing equipment for vibrating piece parts in a finishing media comprising:

a base structure;

a plurality of cylindrical tubes resiliently mounted to said base structure in spaced proximity and having an uppermost tube, a lowermost tube, and one or more intermediate tubes defined thereby, each tube having an inlet and an outlet;

connecting means for selectively interconnecting selected outlets to selected inlets to define selected combined tube lengths; and vibratory means for causing vibratory motion within said cylindrical tubes.

6. The vibratory finishing equipment of claim 5 wherein said connecting means comprises tubular members exhibiting a series of defined direction changes.

7. The vibratory finishing equipment of claim 6 wherein said connecting means comprises three direction changes of approximately 60° each.

8. The vibratory finishing equipment of claim 5 wherein said tubes are positioned around a defined center axis of the vibratory finishing equipment.

9. The vibratory finishing equipment of claim 8 wherein said vibrating means is positioned proximate said defined center axis of said vibratory finishing equipment.

10. The vibratory finishing equipment of claim 8 wherein said vibrating means is positioned proximate the periphery of said vibratory finishing equipment.

11. The vibratory finishing equipment of claim 9 wherein said connecting means comprises tubular members exhibiting a series of defined direction changes.

12. The vibratory finishing equipment of Claim 11 wherein said connecting means comprises three direction changes of approximately 60° each.

* * * * *